US005159308A

United States Patent [19]

Bowder et al.

[11] Patent Number: 5,159,308

[45] Date of Patent: Oct. 27, 1992

[54] THERMOSTATIC SWITCH AND CONTACT ARM THEREFOR

[75] Inventors: Thomas H. Bowder, Coventry, R.I.; Michael F. Donais, Swansea, Mass.

[73] Assignee: Elmwood Sensors, Inc., Pawtucket, R.I.

[21] Appl. No.: 831,795

[22] Filed: Feb. 5, 1992

[51] Int. Cl.[5] ..... H01H 37/52; H01H 37/74

[52] U.S. Cl. ..... 337/354; 337/342

[58] Field of Search ..... 337/354, 342, 349, 343, 337/52, 53, 89

[56] References Cited

U.S. PATENT DOCUMENTS 3,143,614 8/1964 Ege ..... 337/89

4,528,541 7/1985 Hollweck et al. ..... 337/354

*Primary Examiner*—Harold Broome

*Attorney, Agent, or Firm*—Salter, Michaelson & Benson

[57] ABSTRACT

A thermostatic switch has a contact arm which is adapted for reducing contact pressure and maximizing wiping action between fixed and movable contacts. The switch includes a housing, a pair of terminals mounted in the housing, a resilient contact arm connected to one of the terminals, a movable contact on the contact arm, a stationary contact connected to the other terminal, and an actuator assembly for opening and closing the switch. The contact arm is integrally struck from a resilient, electrically conductive metal and it includes a base portion, and a pair of supporting members extending outwardly and upwardly from the base portion and then bending back thereover merging into a main portion. The main portion includes a peripheral edge portion having a contact area, and a plurality of finger portions which converge inwardly therefrom and merge into an actuator portion. The actuator assembly communicates with the actuator portion of the contact arm for moving the contact arm from a normally biased open position, wherein the contacts are in spaced relation, through an intermediate position, wherein the contacts are in initial engagement, to a closed position, wherein the contacts are in at least slightly pressurized engagement and the actuator portion and the finger portions are deflected upwardly relative to the main portion, whereby a transverse wiping action is achieved between the contacts as the contact arm is moved from the intermediate position thereof to the closed position thereof.

5 Claims, 3 Drawing Sheets

THERMOSTATIC SWITCH AND CONTACT ARM THEREFOR

BACKGROUND OF THE INVENTION

The present invention relates to thermostatic switches and more specifically to a thermostatic switch having an improved contact arm which reduces contact loading pressure and maximizes contact wiping action.

The general type of thermostatic switch contemplated herein has heretofore been known in the art. For example, a wide variety of thermostatic switches have been heretofore available which have generally comprised a pair of contacts, one of which is stationary and the other of which is mounted on a relatively simple, bendable contact arm which is operative for closing the switch by connecting the contacts. However, it has been found that the contact arm assemblies of the heretofore available switches of this type have suffered from several problems which can cause malfunctions and therefore reduce reliability.

One such problem which can cause malfunctioning of a thermostatic switch is cold welding of the contacts thereof due to high contact pressure. In this regard, many thermostatic switches of the prior art have utilized high contact pressures to maintain consistent contact over repeated contact cycles. It has been found that high contact pressures can cause the contacts of the switches to become welded together during periods of prolonged contact. Another problem related to high contact pressure is contact fretting or wear after repeated contact cycles. This is because the contacts of thermostatic switches are typically formed from soft precious metals, such as silver, and over repeated contact cycles, soft metal tends to fret or wear away reducing contact reliability and eventually leading to switch failure.

A further problem which can cause malfunctioning of thermostatic switches is microscopic contact fusion. Specifically, it has been found that when a switch is utilized for carrying high currents, material from the contacts thereof can often fuse together due to arcing.

A still further problem is the build up of layers of increased resistance on the surfaces of the contacts of a switch over repeated contact cycles which can also cause premature failure or discontinuities.

SUMMARY OF THE INVENTION

The present invention overcomes the problems of the switches of the above described general type by providing a thermostatic switch having a uniquely configured contact arm which reduces contact pressure and maximizes contact wiping action. Briefly, the instant invention comprises a housing, a pair of terminals mounted in the housing, a unique, resilient contact arm attached to one of the terminals, a movable contact mounted on the contact arm, a stationary contact mounted on the other terminal, and a bimetallic actuator disc communicating with the contact arm for closing the switch.

The contact arm is integrally struck from a resilient, electrically conductive metal and it comprises a base portion, a pair of supporting members extending outwardly and upwardly from the base portion and then, bending back thereover in normally spaced relation thereto merging into a main portion. The main portion includes a peripheral edge portion having a contact area and a plurality of finger portions converging inwardly from the peripheral edge portion and merging into an actuator portion. The actuator disc communicates with the actuator portion of the contact arm through a transfer ball, and it is operative for actuating the contact arm from a normally biased, open position, through an intermediate position wherein the contacts are in initial engagement, to a closed position wherein the actuator portion and the finger portions are deflected upwardly relative to the main portion. The contacts are preferably disposed in slightly offset relation so that they engage in offset relation when the switch is closed. It has been found that by orienting the contacts in slightly offset relation contact pressure is reduced even under highly deflected conditions, and cold welding and contact fusion are reduced. Further, the contact arm is constructed so that as it is moved from the intermediate position thereof to the closed position thereof, the contact arm deforms sufficiently to cause a transverse wiping action to take place between the contacts. It has been further found that because of the configuration of the contact arm, as it is moved past the intermediate position thereof towards the closed position thereof, the finger portions act as a deflection mechanism for causing the movable contact on the contact arm to wipe across the stationary contact. Further, it has been found that the resulting wiping action cleans the contact surfaces to prevent the build up of high resistance surface layers and also to assist in the elimination of cold welding and contact fusion. Still further, it has been found that the finger portions also help to offset the increased loading on the contacts during deflection and wiping. Even further still, a combination of the deflection of the finger portions and the reverse bend of the supporting members creates a controlled, linear build up of forces in the contact. It has also been found that the reverse bend of the supporting members reduces the initial loading pressure during closure thereby permitting the contact arm to be constructed from a heavier, thicker stock material which increases the current carrying capacity, the reliability and the overall life of the switch.

It is therefor an object of the present invention to provide a thermostatic switch which overcomes many of the problems of the prior art by reducing contact pressure and maximizing contact wiping action during closure.

It is another object of the present invention to provide a thermostatic switch having a unique contact arm which is operative for reducing contact pressure and maximizing contact wiping action.

It is further object of the present invention to provide a thermostatic switch which increases current carrying capability, reliability, and life.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
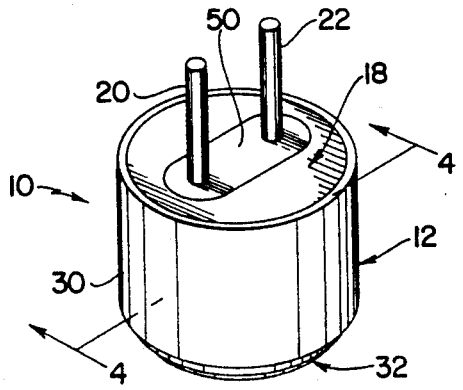
FIG. 1 is a perspective view of the thermostatic switch of the subject invention.

Referring now to the drawings, the thermostatic switch of the present invention is illustrated and generally indicated at 10 in FIG. 1. The thermostatic switch 10 comprises a housing assembly generally indicated at 12, an actuator assembly including a bimetallic actuator disc 14 and an actuator transfer ball 16, a header assembly 18 including first and second terminals 20 and 22, respectively, a resilient contact arm 24 mounted on the first terminal 20, a movable contact 26 mounted on the contact arm 24, and a stationary contact 28 mounted on the second terminal 22.

The housing assembly 12 comprises an outer can 30 having a tiered bottom 32, a washer 34, a wave washer 36, and a hollow inner core 38 which includes a reduced bottom section 40 having a central aperture 42 therein. The outer can 30 is preferably stamped from a suitable metal, such as stainless steel, and the inner core 38 is preferably formed from a suitable insulating material, such as a ceramic.

Figure 2:
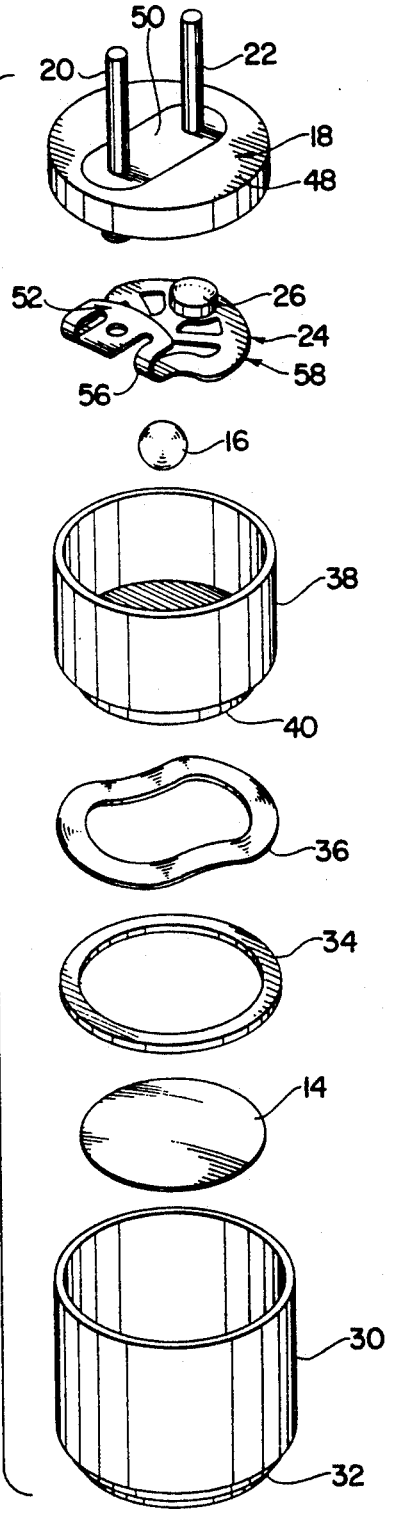
FIG. 2 is an exploded perspective view thereof.
Figure 5:
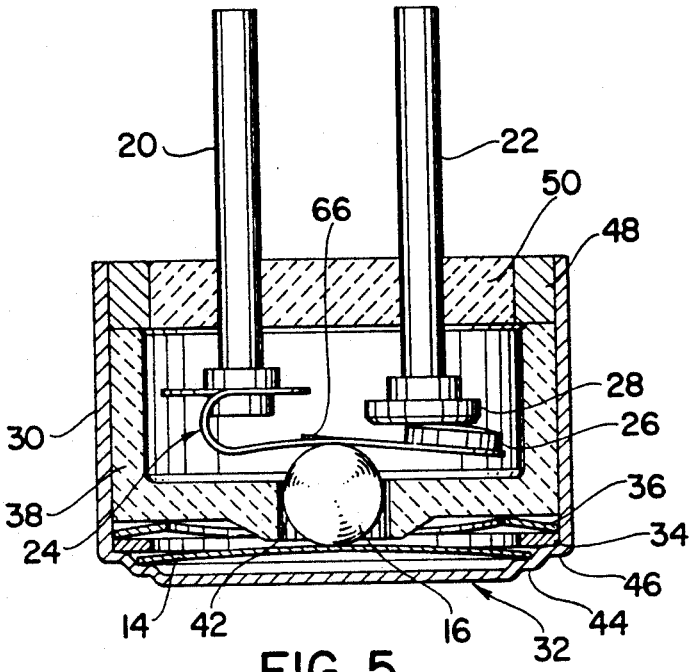
FIG. 5 is a similar view with the contact arm in a closed position.
Figure 4:
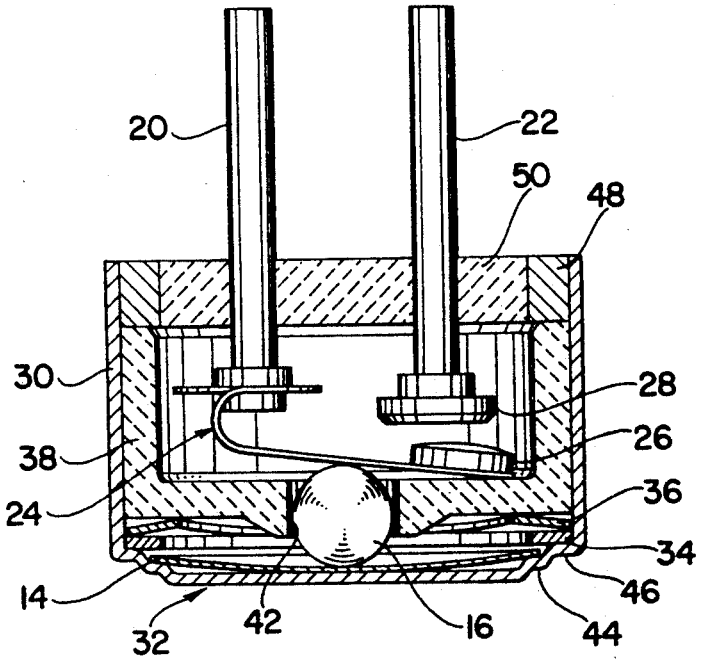
FIG. 4 is a cross sectional view taken along line 4—4 of FIG. 1 with the contact arm in an open position.

Referring to FIGS. 2, 4 and 5, the disc 14, the washer 34, the wave washer 36 and the inner core 38 are received in the outer can 30. The disc 14 is seated on a first shoulder 44 of the tiered bottom 32, the washer 34 is seated on a second shoulder 46 of the tiered bottom 32, the wave washer 36 is seated on the washer 34 and the inner core 38 is seated on the wave washer 36. In this regard, disc 14 is fixed around its outer perimeter between the shoulder 44 and the washer 34 and it is freely actuatable with a flexing action in the center thereof between the actuated and deactuated positions. The actuator transfer ball 16 is received in the aperture 42 and it communicates with the disc 14.

The header assembly 18 comprises a circular header 48 which is preferably stamped from a suitable metal, such as stainless steel, and an insulator core 50 which is located in the center of the header 48. The insulator core 50 is preferably formed from a suitable glass or ceramic material, and the first and second terminals 20 and 22 which are respectively mounted in spaced relation within the core 50. The outer edge of the header 48 is dimensioned so as to be received in the rim of outer can 30.

Figure 3:
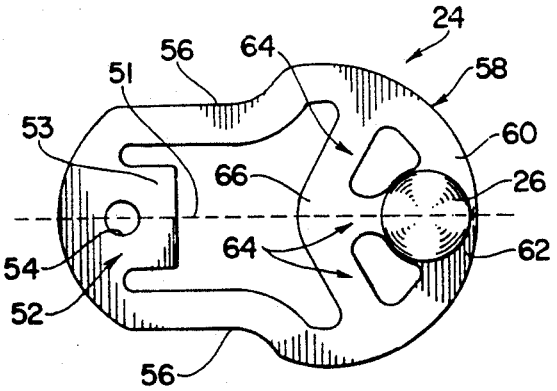
FIG. 3 is a top plan view of the contact arm thereof prior to bending the arm to its final configuration.

Referring now to FIGS. 2 and 3, the contact arm 24 is preferably integrally struck from an electrically conductive, resilient metal such as beryllium copper. The contact arm 24 has a longitudinal centerline 51 and generally comprises a base portion 52, a pair of supporting arms 56, and a main portion 58. The base portion 52 has a generally U-shaped configuration and it comprises an arcuate outer edge and an inwardly extending flange portion 53 which has an aperture 54 therein. A pair of supporting members 56 extend outwardly and upwardly in spaced relation from the base portion 52, and then bend back thereover in normally spaced relation and merge into a main portion generally indicated at 58. The main portion 58 includes a peripheral edge portion 60 having a contact area 62, and three finger portions each of which is generally indicated at 64 which converge inwardly therefrom and merge into a centrally disposed, free actuator portion 66. The aperture 54, the contact area 62 and the actuator portion 66 are substantially aligned in linear relation along the longitudinal centerline 51. The contact arm 24 is mounted on the first terminal 20 with a rivet or the like through the aperture 54 of the base portion 52 and the contact arm 24 is dimensioned so as to position the contact area 62 in substantially aligned relation over the second terminal 22. The three finger portions 64 comprise a central finger portion which extends inwardly from the contact area 62 of the peripheral edge portion 60 and is disposed along the longitudinal centerline 51 of the contact arm 24. A pair of side finger portions extend inwardly from the peripheral edge portion 60 on opposing sides of the center finger portion and are angularly disposed in relation to the centerline 51.

The movable contact 26 and the stationary contact 28 are preferably formed from a suitable soft precious metal, such as silver. As illustrated in FIGS. 3 and 4, the movable contact 26 is attached to the contact area 62 on the contact arm, and the stationary contact 28 is attached to second terminal 22. The contacts 26 and 28 are preferably aligned in slightly offset relation so that they engage in slightly offset relation during closure of the contact arm 24. The header assembly 18, with the attached contact arm 24, is received in outer can 30 so that the header assembly 18 is received on the inner core 38, and so that the actuator portion 66 communicates with actuator transfer ball 16.

Figure 6:
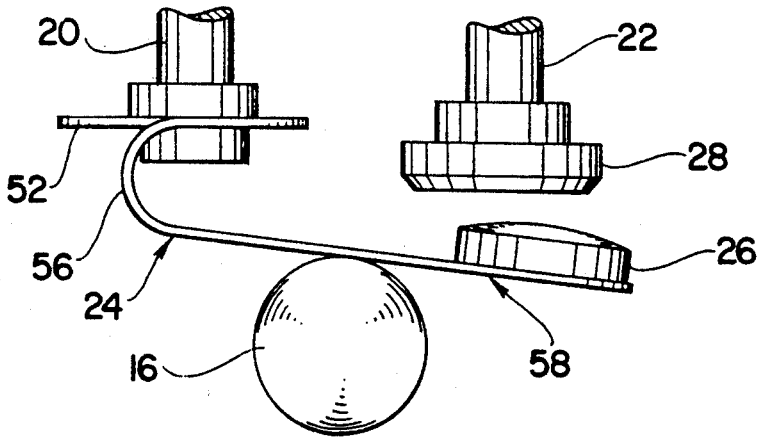
FIG. 6 is an enlarged side elevational view of the contact assembly with the contact arm in an open position.
Figure 7:
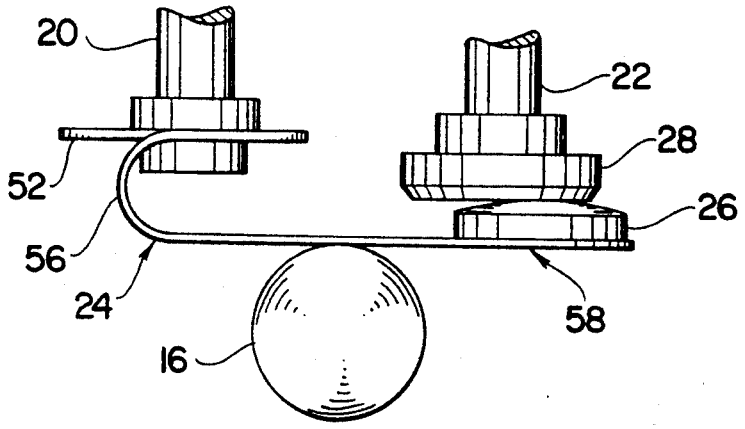
FIG. 7 is a similar view with the contact arm in an intermediate position wherein the contacts are engaged.
Figure 8:
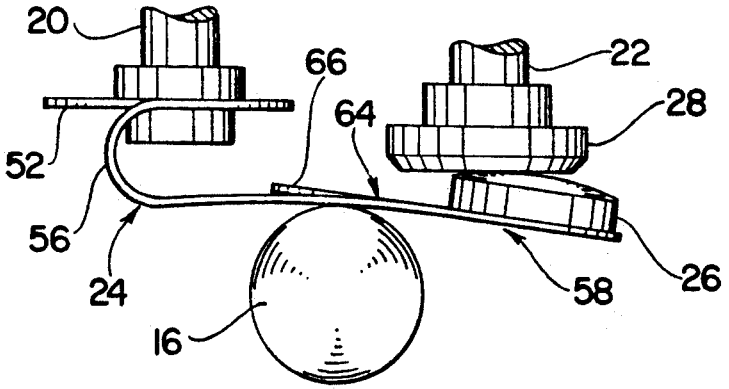
FIG. 8 is a further similar view with the contact arm in a closed and deflected position.

Referring now to FIGS. 6 through 8, transfer ball 16 is operative for moving the contact arm 24 from its normally biased, open position illustrated in FIG. 6, through an intermediate position illustrated in FIG. 7 wherein the contacts 26 and 28 are in initial engagement, to a closed position illustrated in FIG. 8, wherein the actuator portion 66 and the finger portions 64 are deflected upwardly relative to the main portion 58. This upward deflection of the actuator portion 66 and finger portions 64 relative to the main portion 58 causes the movable contact 26 to be transversely moved or shifted slightly across the surface of the stationary contact 28. In this regard, during closure, the contact arm 24 is urged past the intermediate position illustrated in FIG. 7 and thereafter the finger portions 64 act as a deflection mechanism forcing a forward motion of the peripheral edge portion 60 to achieve a wiping action. The finger portions 64 also help to offset the increased loading on the contacts 26 and 28 during the deflection and wiping action. Further, a combination of the deflection of the finger portions 64 and the reverse bends in the supporting members 56 creates a controlled linear build up of pressure between the contacts 26 and 28. Although only three finger portions are illustrated in the drawings, a greater or lesser number of fingers could be utilized to achieve different loading and deflection values depending on the specific configuration of the switch.

It has been found that the configuration and operation of the contact arm 24 also provides several additional advantages in the switch of the subject invention. Specifically, the reverse bends in the supporting members 56 allow a reduction in the initial loading pressure during closure. The geometry of the reverse bends allows the initial loading pressure to be varied according to the radius of the reverse bends. The larger the radius the less the initial pressure will be. The reduced loading pressure allows the use of thicker, heavier stock material for the contact arm 24 which in turn increases the current carrying capacity, reliability and life of the switch 10. A range of different bend radii may be used depending on the desired loading pressure and arm thickness. Further, it has been found that the wiping action between the contacts 26 and 28 cleans the surfaces of the contacts 26 and 28 to prevent the build up of high resistance surface layers thereon. The wiping action also assists in the elimination of cold welding and contact fusion by effectively breaking any connecting material that may be formed during contact engagement. The slightly offset orientation of the contacts reduces contact pressure even under highly deflected conditions and it also assists in the elimination of cold welding and contact fusion by effectively reducing the contact area between the contacts.

It is seen therefor that the instant invention provides an effective thermostatic switch 10 and contact arm 24 therefor which is operative for reducing contact pressure and maximizing contact wiping action. The contact arm 24 and the contacts 26 and 28 are specifically arranged and adapted to reduce contact pressure and maximize contact wiping action during closure, and as a result, the switch of the instant invention effectively overcomes many of the problems associated with the prior art switches. Hence, for these reasons, it is believed that the instant invention represents a significant advancement in the thermostatic switch art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A thermostatic switch comprising:

housing means;

first and second terminals mounted in spaced relation in said housing means;

stationary contact means connected to said first terminal;

an electrically conductive, resilient contact arm comprising a base portion connected to said second terminal, a pair of supporting members extending outwardly and upwardly from said base portion in spaced relation, and bending back in normally spaced relation thereover, said supporting members merging into a main portion including a peripheral edge portion having a contact area substantially aligned over said stationary contact means, and a plurality of finger portions converging inwardly from said peripheral edge portion and merging into an actuator portion;

movable contact means on said contact arm in substantially aligned, normally spaced relation to said stationary contact means; and actuator means communicating with said actuator portion for moving said contact arm from an open position wherein said movable and stationary contact means are in spaced relation, through an intermediate position wherein said movable and stationary contact means are in initial engagement to a closed position wherein said actuator portion and said finger portions are deflected upwardly relative to said main portion;

said movable contact means shifting at least slightly across said stationary contact means to achieve a wiping action therebetween as said contact arm is moved from said intermediate position thereof to said closed position thereof.

2. In the thermostatic switch of claim 1, said movable and stationary contact means being aligned in slightly offset relation such that said movable and stationary contact means engage in slightly offset relation as said contact arm is moved from said open position thereof to said intermediate position thereof.

3. In the thermostatic switch of claim 1, said base portion having a generally U-shaped configuration and comprising an arcuate edge and an inwardly extending flange portion having a centrally disposed aperture therein.

4. In the thermostatic switch of claim 3, said contact arm further comprising a longitudinal centerline, said aperture, said contact area, and said actuator portion being substantially aligned in linear relation along said centerline.

5. In the thermostatic switch of claim 4, said plurality of finger portions comprising a center finger portion extending inwardly from said peripheral edge portion longitudinally along said centerline and a pair of side finger portions extending inwardly from said peripheral edge portion angularly disposed to said centerline and positioned on opposing sides of said center finger portion.

* * * * *